United States Patent [19]

Cornelson et al.

[11] Patent Number: 4,695,056

[45] Date of Patent: Sep. 22, 1987

[54] VARIABLE SURFACE BOARD GAME

[75] Inventors: Donald P. Cornelson, Seattle; Jess W. Carlson, Everett, both of Wash.

[73] Assignee: C & C Concepts, Inc., Seattle, Wash.

[21] Appl. No.: 779,165

[22] Filed: Sep. 23, 1985

[51] Int. Cl.[4] ..... A63F 3/02; A63F 3/00

[52] U.S. Cl. ..... 273/262; 273/253; 273/256; 273/284

[58] Field of Search ..... 273/253, 255, 256, 262, 273/284, 242, 250, 283

[56] References Cited

U.S. PATENT DOCUMENTS

| | | | |
|---|---|---|---|
| 1,978,107 | 10/1934 | Hoffmann | 273/153 R |
| 2,585,268 | 2/1952 | Olsen | 273/258 |
| 3,037,773 | 6/1962 | Chambers et al. | 273/253 |
| 3,206,887 | 9/1965 | Evler et al. | 446/93 |
| 3,309,092 | 3/1967 | Hardesty et al. | 273/248 |
| 3,565,438 | 11/1968 | Bischof | 273/253 |
| 3,973,775 | 8/1976 | Bolan et al. | 273/253 |
| 4,078,804 | 3/1978 | Coster et al. | 273/284 |
| 4,079,941 | 3/1978 | Morales | 273/260 |
| 4,157,184 | 6/1979 | Recard | 273/253 |
| 4,232,864 | 11/1980 | Yaworsky | 273/241 |
| 4,296,928 | 10/1981 | Nick | 273/262 |
| 4,341,386 | 7/1982 | Kleva | 273/239 |
| 4,385,765 | 5/1983 | Munn et al. | 273/253 |
| 4,570,939 | 2/1986 | Tourville et al. | 273/253 |

OTHER PUBLICATIONS

Teaching Concepts, Inc., Advertisement Literature, "Space Hop", 1980.

Games Master Catalog, EON Products, Inc., "Cosmic Encounter", 1980, p. 45.

*Primary Examiner*—Anton O. Oechsle
*Assistant Examiner*—Benjamin Layno
*Attorney, Agent, or Firm*—Delbert J. Barnard

[57] ABSTRACT

A playing board (10) is provided which includes a pattern of areas (16), each area (16) including a pattern of position marks (18). A deck of cards (34) is shuffled and dealt face down, one card on each of the areas (16). The cards (34) are turned over in the play of the game. A first type of card (34) identifies a planet. When such a card (34) is revealed it is removed from the board (10) and replaced with a planet identifying marker (52). A second type of card (34) identifies an asteroid or some other obstacle. When such a card (34) is encountered it is removed from the board (10) and an obstacle identifying marker (50) is set in its place. The remaining cards (34) merely indicate space and they are removed from the board (10) to expose the areas (16) and position marks (18) below them. The game (10) is then played with the playing surface of the board (10) comprising the planets, the obstacles and surrounding space.

26 Claims, 13 Drawing Figures

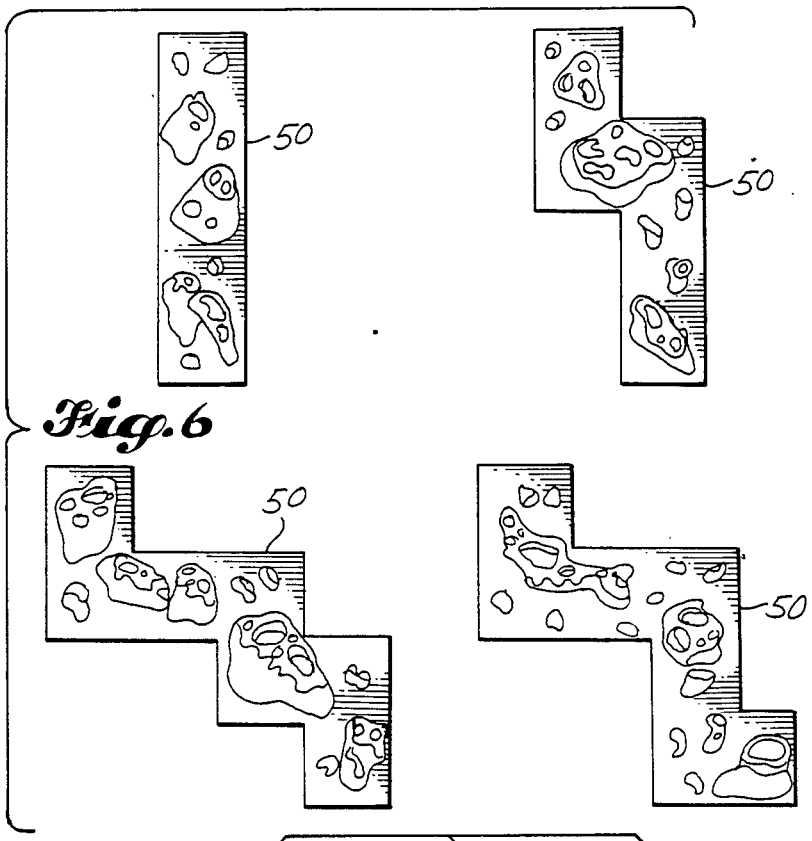
Fig. 6
Fig. 7
| STRENGTH | | UNIT COST | | |
|---|---|---|---|---|
| 0 | SHIELDS | 1 | 1 | 1 |
| 17 | CRUISER | 8 | 4 | 4 |
| 15 | INTERCEPTOR | 5 | 3 OR 3 | |
| 19 | PLANETS-BASES | MET | CRY | CNN |
26
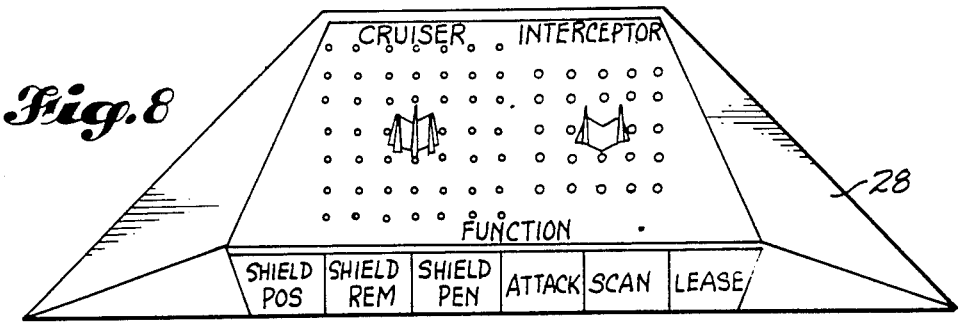
Fig. 8

Fig. 9
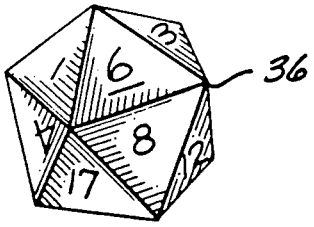
Fig. 10
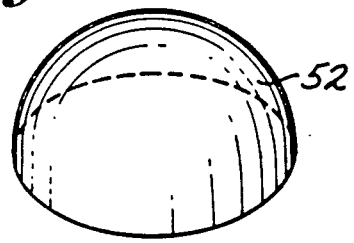
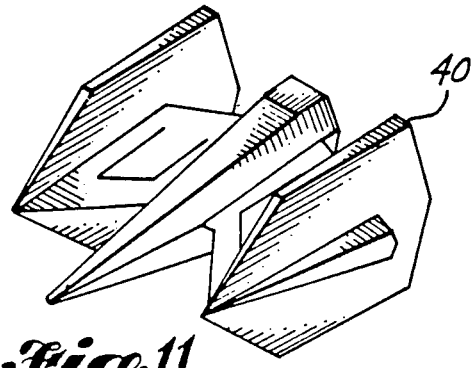
Fig. 11
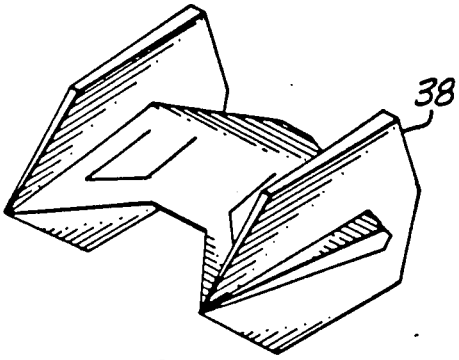
Fig. 12
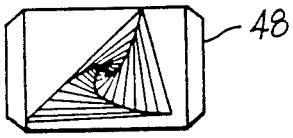
Fig. 13

VARIABLE SURFACE BOARD GAME

DESCRIPTION

Technical Field

This invention relates to a board game. More particularly, it relates to a board game having a game board with a pattern of player position marks on it, overlays for blocking off some of the position marks, and a set of cards usable for determining the position of the overlays, resulting in the game board having a playing surface which is different for each game.

Background Art

There are many types of board games and some of them involve different ways of changing the face or pattern of a game board. Examples of known games of this type existing in the patent literature are disclosed by the following U.S. Pat. Nos.: 1,978,107, granted Oct. 23, 1934, to Henry Hoffmann; 2,585,268, granted Feb. 12, 1952, to Paul Olsen; 3,206,887, granted Sept. 21, 1965, to John F. Eyler, Claude R. Sides, Gene F. Murray and Edward J. Cosby; 3,309,092, granted Mar. 14, 1967, to Floyd W. Hardesty and Irvin Wschenck; 4,078,804, granted Mar. 14, 1978 to Ora Coster and Theo M. Coster; 4,079,941, grated Mar. 21, 1978, to Joseph Morales; 4,232,864, granted Nov. 11, 1980, to James J. Yaworsky and 4,341,386, granted July 17, 1982, to Jacob J. Kleva.

The above listed patents should be carefully considered for the purpose of putting the present invention into proper perspective relative to the prior art.

Disclosure of the Invention

The board game of the present invention is a multiple player competing board game. It is basically characterized by a playing board having a central portion comprising a pattern of areas. Each area includes a plurality of position marks. Player start positions border the central portion. In addition to the game board, the game includes a plurality of property identifying markers, a plurality of obstacle identifying markers, at least one position marker for each player, and a plurality of playing surface determining cards. Each of the cards has a front side and a back side. A first group of the cards has property identifying indicia on their front sides. The second group of the cards has obstacle identifying indicia on their front sides. The third group of cards has some other identifying indicia on their front sides.

In the playing of the game, the cards are shuffled or otherwise mixed with their face sides concealed. The cards are then dealt face down on the areas of the central portion of the playing board, and then turned over (individually during a player's turn). Each card of the first group is replaced with a property marker corresponding to property identified on the card. Each card of the second group is replaced by an obstacle marker corresponding to an obstacle on the card. The third group of cards are merely removed from the board, so as to expose for use in the play of the game the position marks on the areas from which such cards were removed.

The game of this invention is particularly suited for use as a game having a theme involving space travel, exploration and conquest. In preferred form, the property identifying cards and property identifying markers identify planets. The obstacle identifying cards and the obstacle identifying markers identify asteroids or other things in space other than the planets.

Other more detailed features of the game, including other game elements and their use in the play of the game, are set forth below in the detailed description of the preferred embodiment.

BRIEF DESCRIPTION OF THE DRAWING

Like reference numerals are used to denote like parts throughout the several views of the drawing, and:

FIG. 6 is a plan view of the face sides of a plurality of "obstacle" cards;

FIG. 7 is an enlarged scale view of one of the areas of information indicia appearing on one side of each player's start position;

FIG. 8 is a view like FIG. 7, but of the information area on the opposite side of the players' start positions;

FIG. 9 is a perspective view of a twenty sided die;

FIG. 10 is a pictorial view of a three dimensional "planet marker";

FIG. 11 is a pictorial view of a first type of player position marker;

FIG. 12 is a pictorial view of a second type of player position marker; and

FIG. 13 is a plan view of a "shield."

BEST MODE FOR CARRYING OUT THE INVENTION

Figure 1:
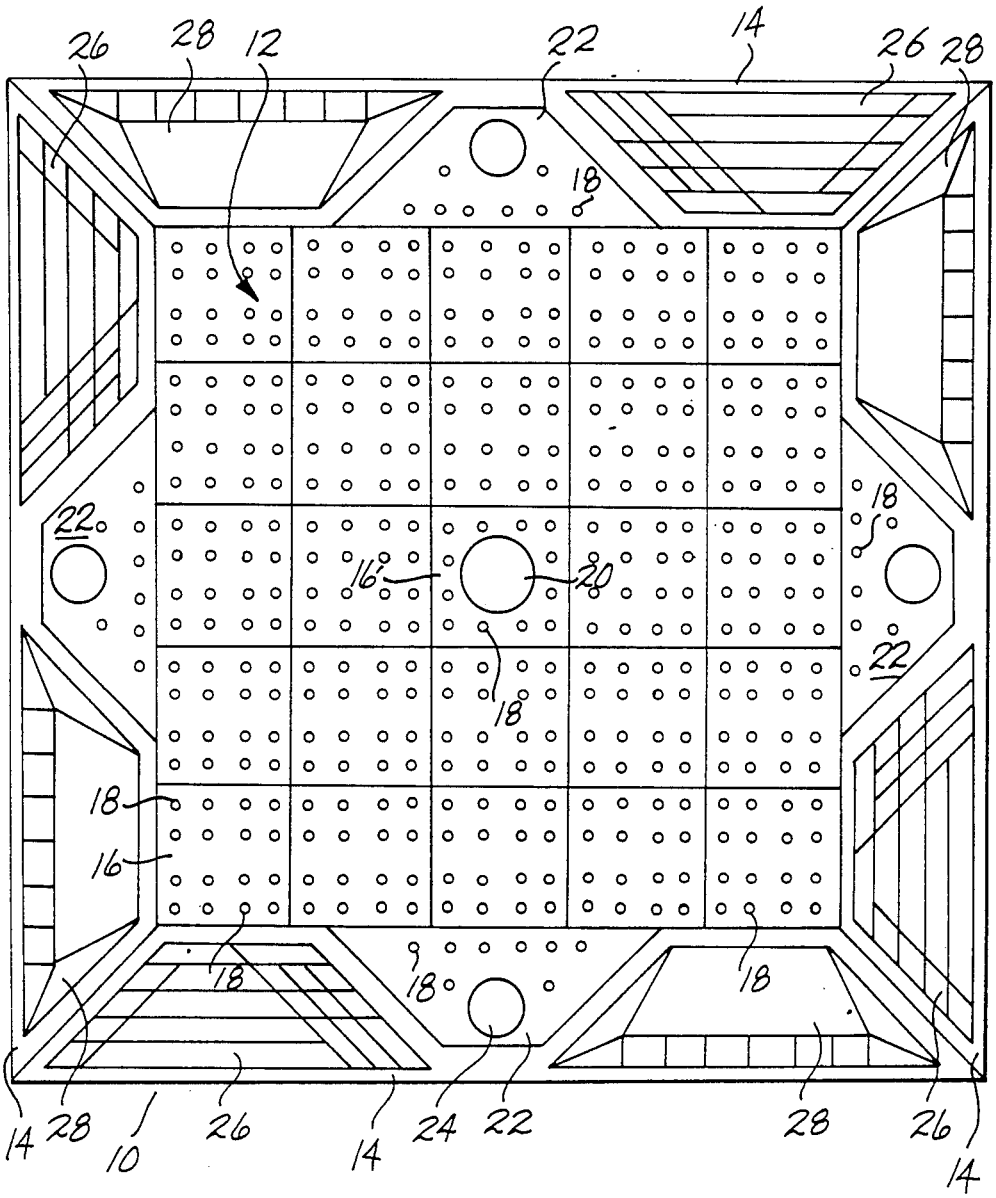
FIG. 1 is a plan view of an embodiment of the game board, such view showing the game board as basically comprising a central portion in the nature of a rectangular grid of areas, each of which includes a pattern of position marks, a players' "start" positions at each side of the board, and player information areas on each side of the board flanking the players' "start" positions.

Referring to FIG. 1, in preferred form, the game board comprises a central portion 12 flanked by four side portions 14. The central portion 12 is a rectangular grid. The grid 12 is composed of areas 16 which are herein referred to as "quadrants". Each area or quadrant 16 includes a plurality of position marks 18. The marks 18 may be established in a grid pattern, as illustrated.

In the preferred embodiment, the central portion 12 of the game board 10 is designed to represent a solar system. It is divided into twenty-five quadrants 16. Each quadrant 16 has sixteen position marks 18 which may be called "sectors". Sectors are used for ship movement and the placement of other playing pieces.

In preferred form, the grid 12 has a center area 16' which is referred to as the "sun quadrant". It may have a circular representation 20 of the sun at its center, flanked by position marks or sectors 18. The sectors in the sun quadrant are called "sun sectors".

In the illustrated embodiment, the grid 12 comprises areas or quadrants 16 which are square. The sun quadrant 16' comprises twelve position markers or sun sectors located about the sun circle 20.

The player areas 14 on the sides of the board are divided into three parts. The center part 22 represents the "home space" and "start position" for the player. It may include "galactic bases", indicia 24, and a plurality of position marks 18, i.e. home space sectors. Each player starts from his home space. Each side portion 14 also comprises a pair of information areas 26, 28. FIG. 7 shows information area 26 and FIG. 8 shows information area 28.

Figure 2:
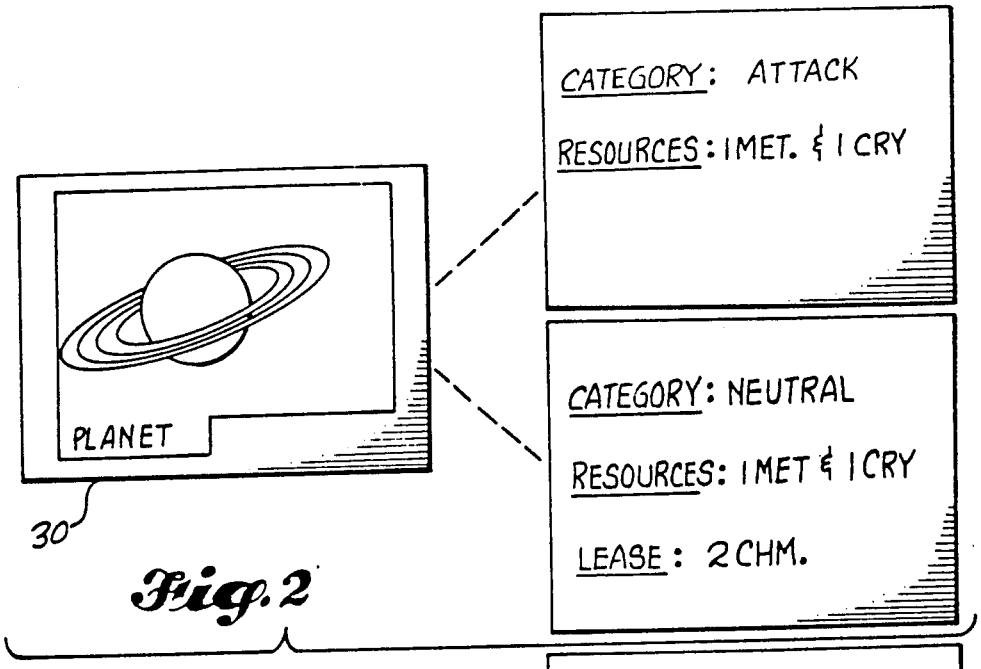
FIG. 2 is a plan view of the front sides of a plurality of "planet" cards.
Figure 3:
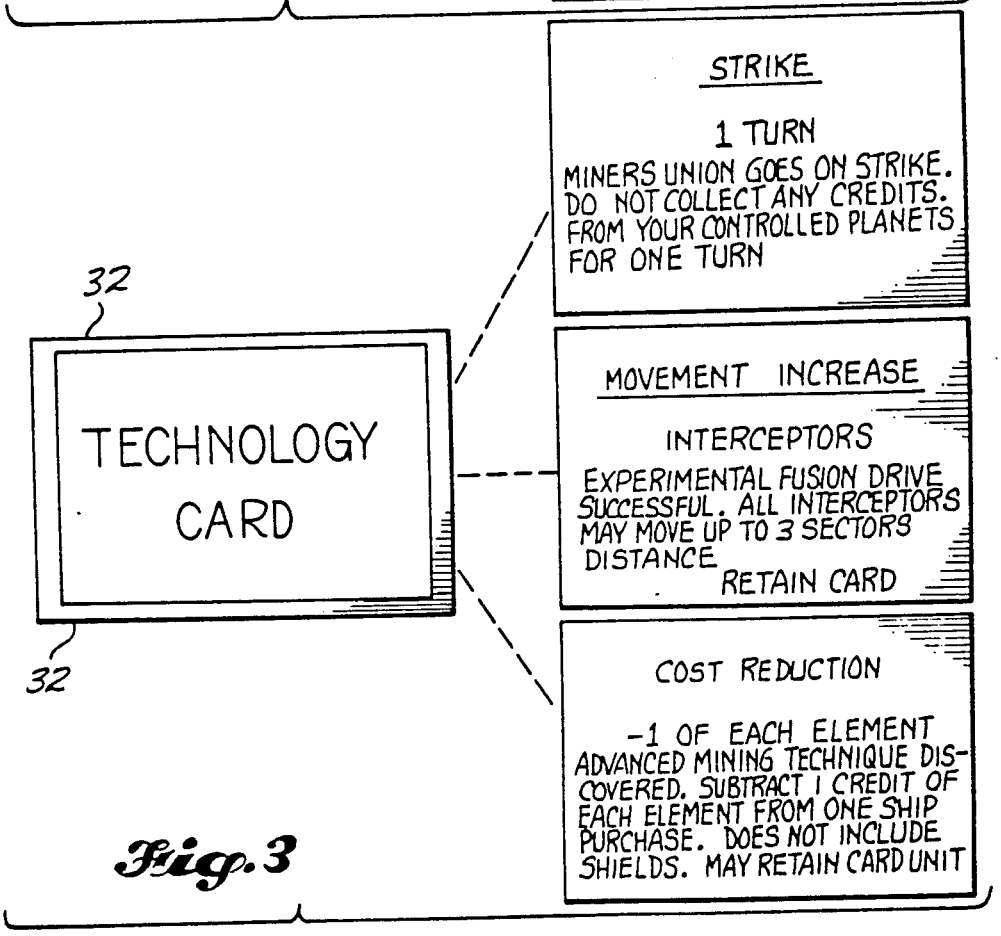
FIG. 3 is a plan view of the face sides of a plurality of "technology" cards.
Figure 4:
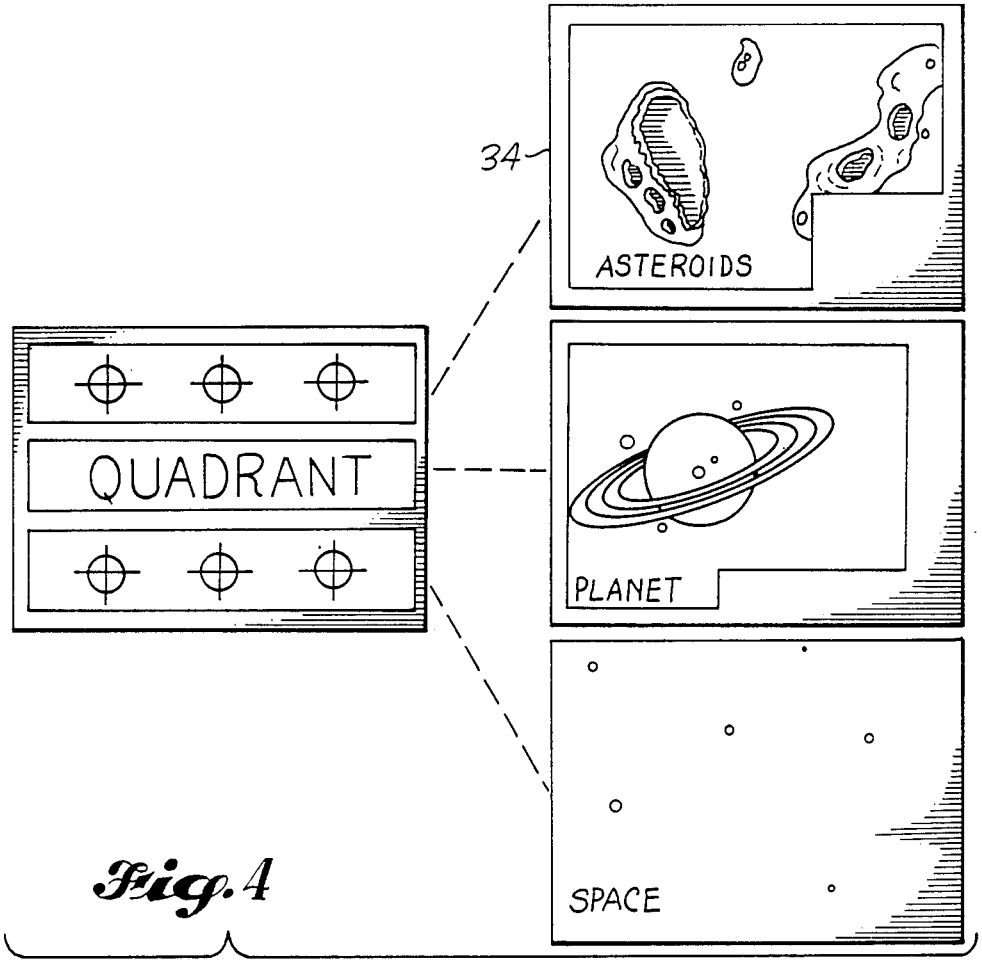
FIG. 4 is a plan view of the face sides of a plurality of "quadrant" cards.
Figure 5:
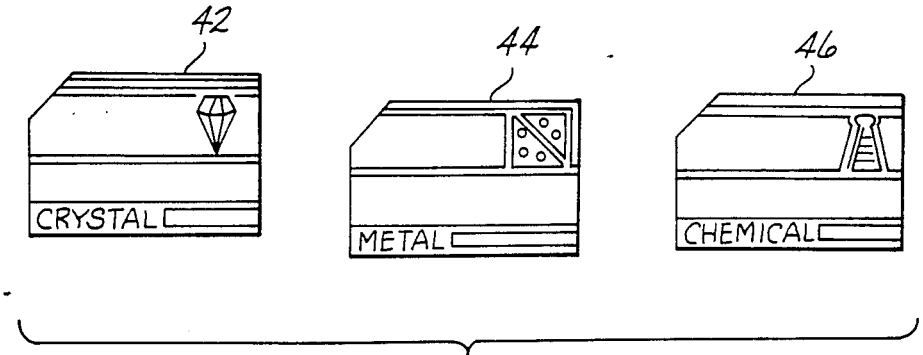
FIG. 5 is a plan view of the face sides of a plurality of "credit" cards.

The preferred embodiment includes three types of cards. These are termed "planet" cards 30 (FIG. 2), "technology" cards 32 (FIG. 3), and "quadrant" cards 34 (FIG. 4).

In preferred form, there are thirty quadrant cards 34. Twenty-two of these cards will say "space" on their faces, or will include an identifying indicia of some sort on their faces which can be used to identify them. Five of the cards will say "planet" and four of the cards will say "asteroid".

In the play of the game, the quadrant cards 34 are shuffled and are dealt face down, one in each of the twenty-four vacant quadrants 16. The twenty-fifth quadrant is the sun quadrant 16'. This quadrant 16' does not receive a card. The remaining cards are not looked at but rather are merely discarded for the duration of the game. This use of more cards than there are quadrants 16 will give greater variety to the game.

The planet cards 30 (FIG. 2) each identify a particular planet and set forth characteristics of the planet. There are fifteen planet cards 30. During the set-up stage of the game these cards are shuffled and stacked ready for drawing.

During the play of the game a planet card is drawn when a player "scans" a planet. The planet cards 30 will give three characteristics of each planet. The first characteristic is termed the "planet category." There are two categories, "neutral" or "attack." The second characteristic presented on a planet card is termed the "element resources." This is indicia showing the amount of metal, crystal or chemical credits that the controlling player will receive each turn. If the planet category is "neutral", the card will also include "lease" information. This will be the price for purchasing the element resources and peaceful control of the planet.

Planets which are designated "attack" will not have a lease because these planets can only be controlled through battle.

Technology cards 32 are cards which either benefit or hinder a player's progress.

In the preferred embodiment, each player has two types of position markers. Specifically, he begins with three of a first type of marker 38 termed "solar interceptors". He also begins with three of a second type of marker 40 termed "solar cruisers". These "ships" may be placed in any order in the player's home space. In a preferred embodiment, each home space comprises eight sectors surrounding the players galactic base.

A chance means may be provided in the form of a twenty sided dice 36 (FIG. 9) or a spin wheel, etc.

In the play of the preferred form of the game, a dice 36 is used to perform several functions. Firstly, if the number produced by a player's roll of the dice is "12" or greater, such player must draw a technology card 32. Secondly, the roll of a dice 36 is used to determine the results of each battle. The number rolled represents the amount of damage inflicted on the target. For example, all active playing pieces may be given a strength number. If an attacking player rolls this number, or a larger number, the target is defeated. The strength of each playing piece may be set forth in the information area 26.

Referring to FIG. 7, in the illustrated embodiment, the galactic bases 24 and the planets are given a strength value of "19." The playing pieces termed "solar cruisers" are given a strength value of "17." The playing pieces termed "solar interceptors" are given strength value of "15."

The "money" in this game is termed "element credits." These element credits exist in the form of cards or chips 42, 44, 46. They represent the natural resources that can be obtained from a planet or gathered from otherwise vacant space. In preferred form, there are three types of element credits. They are "metal", "crystal", and "chemical." As will hereinafter be explained, the element credits are earned by a player during the play of the game. They are then used by the player to purchase additional ships and "shields."

Energy shields 48 or simply "shields" are barriers that protect the sectors on which they are placed. Ships 38, 40 may not move or attack through a sector protected by an energy shield 48. A player may position an energy shield 48 on any sector in the quadrant occupied by one of his/her ships. Once the shield 48 is placed, the ship 38, 40 may leave the quadrant and the shield 48 will remain in position. A ship 38, 40 may position any number of shields 48 each turn.

As shown by FIG. 6, the "asteroids" function as obstacles. They are printed blocks 50 and they are placed on certain areas of the quadrants.

The object of the game is to control the solar system by conquering the enemy galactic bases. This is accomplished by gaining advantages through the control of various planets. Planet control helps a player build up a fleet of support ships. A player wins the game when all opposing players are eliminated.

In preferred form, the game board begins as an unexplored solar system. At this time the quadrant cards are positioned face down on the quadrants. As the players explore the system, planets and asteroids will be discovered (by "scanning" hereinafter described). Their positions will change from game to game creating a different solar system every time. No two games are alike, resulting in each game being exciting and new. As the planets are discovered, the players will try to gain control of them. This may be done peacefully or through the use of force. A player controlling a planet or planets will receive credits that can be used to acquire more support ships and shields. The more planets a player controls the more ships and shields he may acquire. As players seek to control planets and sections of space, conflicts will arise. The results of these conflicts will determine the final outcome. A player's choice could mean victory or destruction. The set-up and play of the game will now be described.

Each player begins with three solar interceptor 38 and three solar cruisers 40. They may be placed in any order in the player's home base 22.

The quadrant cards 34 are shuffled and dealt face down, one in each quadrant 16 of the board 10, except for the sun quadrant 16'. The remaining six quadrant cards 34 are set to one side without any player seeing them. The planet and technology cards 30, 32 are then shuffled and stacked face down, ready for drawing. Planet markers 52 (FIG. 10) are ready for placement on the board.

If desired, the players can roll the dice 36 to determine the order of play. For example, the player rolling the highest (or lowest) number may begin first. Then play may continue from player to player in the clockwise or counterclockwise direction.

Each turn of each player will involve the following acts, and in this order: The player whose turn it is starts his turn by a roll of the dice 36. If the number produced is "12" or greater, the player must draw a technology card 32. The message on the technology card may be beneficial to the player or may hinder the player's progress. Unless stated otherwise, a technology card is affective the turn it is drawn and only affects the player drawing it. The second step of a player is to collect controlled planet element credits if any. Thirdly, the player makes ship movements and/or functions. Lastly, the player purchases additional ships.

As will later be described in detail, there are six ship functions. They are (1) attack, (2) scan, (3) lease, (4) positioning, (5) removing an energy shield, and (6) penetrating an energy shield. Solar cruisers and solar interceptors may perform any of the six functions. However, they may never perform more than one function per turn.

A player earns element credit chips 42, 44 and 46 (one each) each time he scans a quadrant or planet. The amount and type of element credit chips 42, 44, 46 earned for controlled planets are stated on the planet card. The amount and type of credit varies from planet to planet.

Element credits 42, 44, 46 earned for scans are collected immediately after the scan is completed. Element credits earned for controlled planets are taken at the beginning of each turn. A player does not return element credits during the turn that he takes control of a planet. He must wait for the beginning of his next turn. Element credits must be taken at their proper time to avoid confusion and disagreement.

Support ships and shields can be acquired (bought) using element credits. The amount and what type of element credits needed is stated on the cost table on the game board 10 (FIG. 7). Support ships and shields can only be acquired at the end of a player's turn. By way of example, a solar cruiser may cost eight metal chips, four crystal chips and four chemical chips. A solar interceptor may cost five metal chips and either three crystal chips or three chemical chips. A shield may cost one metal chip, one crystal chip and one chemical chip.

The attacking function will now be described:

All attacks are made by a roll of the 20-sided dice 36. The object is to roll a number equal to or greater than the strength number given to the target. The strength of each playing piece can be found on the strength table on the playing board (FIG. 7). Galactic bases, control planets and support ships can attack once a turn. Support ships cannot attack if they have performed any other function in the same turn. Galactic bases and control planets can only attack the ships bordering them just as they can only be attacked by ships bordering them.

Galactic bases, control planets and any number support ships may be used to attack the same target. The attack numbers rolled (by the die 36) are added together to give the total damage for that turn. If the total is equal to or greater than the strength number of the target, the target is defeated.

For example, let it be assumed that player "A" has three interceptors in position to attack player "B's" cruiser. Player "A" rolls a six, nine and twelve for his three interceptor attacks. The total "27" is greater than 17, the strength of a cruiser. Therefore, player "B's" cruiser is destroyed and removed from the board. Player "A" would not have needed all three interceptors if the first roll, or the total of his first two rolls, would have totalled 17 or more.

A player must always identify the attacking ship and target. This cannot be changed after a roll.

Galactic bases and all planets have first strike capability. First strike capability is the right to roll first against any attacking ship. The attacking player must identify which ship is attacking so that the defensive player can roll against it. If the ship is not defeated, the attacking player may then attack with that ship. If more than one ship is used to attack, the base or planet has one first strike roll against each attacking ship. There is no accrued damage for first strike rolls because there is only one roll against each attacking ship. For example, player "A" has four interceptors in position to attack player "B's" controlled planet. Player "A" identifies which interceptor will attack first. "B" rolls a twelve for his first strike blow against interceptor number one. Player "B" needed to roll at least a fifteen to defeat an interceptor, so interceptor number one is not defeated and can roll an attack. Player "A" then rolls a seven as his roll for interceptor number one. The player "A" identifies interceptor number two. Player "B's" first strike roll against interceptor number two is a nine. This is not enough to defeat the interceptor, so player "A" now rolls on behalf of interceptor number two. For example, he rolls a five. Player "A's" accrued damage is now twelve. "A" identifies interceptor number three. Player "B's" first strike roll is an eighteen. This number is large enough to defeat interceptor number three, so interceptor number three is removed from the board. Next, player "A" announces that he will attack with interceptor number four. Player "B" rolls a number three for his first strike roll. This is not enough to defeat the interceptor, so player "A" rolls the dice on behalf of interceptor number four. If, for example, player "A" rolls a twelve, player "A's" total accrued damage is 24, so player "B's" ship is defeated and is now controlled by player "A".

In the play of the game, each galactic base is a planet in itself. Because of its immense size it must orbit the outer edge of the solar system. It was not engineered to withstand the strong gravitational pull of a sun or planet, or to avoid the many hazards of a cramped, active solar system. Its purpose is to transport the support ships to a target and to use the raw materials acquired to manufacture the equipment needed to further the campaign.

The galactic base is also the command center and is crucial to a player's survival. If a player's galactic base is conquered, the player loses the war. A galactic base has a strength of nineteen, for example. If it is defeated in the attack, no matter how many ships or element credits the player has, all ships, element credits, technology cards, and controlled planets owned by the defeated player become the property of the victorious player. The ships may be exchanged for the victorious player's pieces if his ship supply is sufficient. If not, the victorious player may use the defeated player's pieces. The defeated galactic base is not used during the remainder of the game. A galactic base may attack once a turn but may only attack or be attacked by those ships occupying sectors bordering it. A galactic base also has first strike capability. The use of this first strike capability is the same as has been described above in connection with first strike capability of a planet.

As stated before, there are two types of support ships. These are solar cruisers and solar inceptors. By way of example, a solar cruiser may have the strength value of seventeen. A solar interceptor may have a strength value of fifteen.

Support ships are used to explore the solar system and attack the enemy. They can be moved from sector-to-sector and may perform certain ship functions. During each turn, a player must move at least one ship but may move as many as he choses. Support ships may move, perform a function or both during a turn and in whatever order the player chooses.

Solar cruisers may move one to three sectors in any direction or combination of directions in a turn. Solar interceptors may move one or two sectors in any direction or combination of directions. Ship movement does not have to be in a straight line. A ship may never move over or on a sector occupied by another piece.

As mentioned above, there are six ship functions, viz. attack, scan, lease, positioning, removing an energy shield and penetrating an energy shield.

Solar cruisers may attack any enemy ship from up to three sectors distance. Solar interceptors may attack up to two sectors distance. All attacks must be in a straight line and nothing can block the line of attack. To attack a planet or galactic bse, a support ship must occupy a bordering sector.

Scanning is the way that the solar system is explored and is the initial way of acquiring element credits. Quadrants and planets must be "scanned" to find our their characteristics. In order to scan, a support ship must occupy a sector bordering the quadrant or planet to be scanned.

A quadrant is considered uncharted until it is scanned at which time the quadrant card is turned over. One of three things will be found—a planet, an asteroid or space. If a planet is found, the quadrant as shown in FIG. 4, is removed from the board the planet marker 52 (FIG. 10) is placed in the center of the quadrant and the quadrant card is placed in any convenient area observable by the players and displayed to show that the planet indicated by the quadrant card is on the board. When asteroids are found they are placed by the scanning player according to the diagram on the quadrant card and the card is discarded. If "space" is found, nothing is placed in the quadrant and the card is discarded.

When a quadrant is scanned and a planet is found, any player in his turn may move into position to scan the planet. A planet card is drawn by the scanning player and is placed in any convenient area so that the characteristics of the planet indicated on the planet card are clearly visible to all players. Only one planet card is drawn for each planet scanned.

A player may control a planet where the category is neutral by paying the lease price. The player must have a ship bordering the planet before he can lease the planet.

Energy shields are not permanent barriers. Energy shields may be removed by the player that positioned it, or be penetrated by an opposing player.

To remove a shield the owning player simply takes the shield off the board and moves a ship into the vacated sector. A ship must be in movement range to remove a shield.

To penetrate an energy shield the opposing player identifies which ship is involved in a penetration attempt. The player owning the shield rolls the dice to attack. If the number is greater than or equal to the strength number of the ship, the ship is defeated and removed from the board. If the number is less, the shield is removed and the penetrating ship must occupy the vacated sector.

The discovery and control of planets is a vital part of a successful campaign. Planets have a strength of nineteen. The number of planets and their characteristics will change from game to game.

When a quadrant is scanned and a planet is found, any player, in his turn, may move into position to scan the planet. A planet can only be scanned once and cannot be attacked until it has been scanned. A planet card is drawn to scan a planet. There are two types of planets, as indicated by the category given on each planet card. These are "neutral" and "attack".

If the planet is "neutral", a player may control it by paying the lease price given on the planet card, or may control the planet by conquering it in battle. To lease a planet a player must pay the amount and type of credits given under "lease" on the planet card. Because a lease is a function, a ship cannot lease if it has performed any of the other functions in the same turn.

If a player wishes to conquer a planet, he may attack with any number of ships in position. Ships may accrual damage against the planet, as previously described.

If the planet is "attack", it will immediately attack the ship scanning it. To do this the player on the right of the scanning player rolls the dice for the attack. If the roll is greater than the strength of the ship scanning it, the ship is destroyed or removed from the board. An attack planet always attacks the scanning ship. After this initial attack, the attack planet will only attack those ships attacking it. An attack planet may not be leased. It can only be controlled through battle.

As previously stated, all planets have first strike capability.

For a ship to scan, lease, attack or be attacked by a planet, it must occupy a sector bordering the planet. If a player is successful in conquering a planet or leasing it, he places an energy shield on the planet, at no cost, as a symbol of his control. A controlled planet may be used once per turn to attack an enemy ship bordering it. Its attack roll may be added for accrued damage.

As long as a planet is controlled by a player, the player will receive the element credits given under element resources on the planet card, at the beginning of each turn. Element credits are not given for the turn that the planet is either conquered or leased.

When asteroids are found, they are placed by the player scanning the quadrant according to the diagram on the asteroid card. Ships may not move or attack through asteroids. Asteroids form a permanent barrier.

The heart of every solar system is the sun. In accordance with the game, the support ships are capable of withstanding the sun's awesome power. A support ship may actually enter the sun's gaseous surface for a temporary period of time without damage. A support ship may not occupy a sun sector for more than one turn. If it does, it will disintegrate due to the tremendous heat of the sun. In accordance with a rule of the game, when a support ship has penetrated the sun's surface, to occupy a sun sector, its delicate instrumentation becomes useless. Therefore, a ship cannot attack, be attacked or position energy shields while occupying a sun sensor.

The game is designed to be played by four players, one for each home base. However, the game can also be played by either two players or three players.

In a two player game, the players must choose galactic bases opposite each other. The remaining two galactic bases and their home bases are not used and are considered to be outside the play area. Six quadrant cards marked "space" are removed from the deck. The remaining twenty-four cards are shuffled and are dealt one in each vacant quadrant except for the three quadrants bordering each of the players home space. The players begin with three solar cruisers and four solar interceptors. They may be placed anywhere in the home space or in the three vacant quadrants bordering the home space. In other words, each players's home space is in effect enlarged by the amount of three quadrants. Ships acquired during the game must begin from the home space as in the four player game. All other rules remain the same.

In a three player game one player will be positioned between two other players. This player has a disadvantage because he has two borders to defend and may be attacked by both sides. The two players opposite each other only have to defend against the player between them. Therefore, the middle player will be given some advantages in the initial set-up of the game. As in the two player game, six quadrant cards marked "space" are removed from the deck. The remaining cards are dealt on the board like in the two player game with no cards being dealt in the three quadrants bordering the home spaces for the two players opposite each other. The middle player will have quadrant cards dealt in his three bording quadrants. This will give him the advantage of collecting more scan credits and give the possibility of a planet being positioned closer to his home space. All three players begin with four solar interceptors but the middle player begins with four solar cruisers. The other two players begin with only three solar cruisers. Unlike the two player game, all ships must begin from their home space. The players roll the dice to choose galactic base positions. For example, the player rolling the highest number may choose first and the player rolling the smallest number may choose last. The player in the middle always begins and play is controlled clockwise. All other rules remain the same.

The above described game for four players, two players, and three players have been designed to provide games of maximum interest to the players involved. However there can be many variations of the game and experienced players may want to devise additional functions.

What is claimed is:

1. A multiple player competing board game, comprising:

a playing board having a central portion comprising a pattern of areas, each said area including a plurality of position marks, and player start positions on each side of the board bordering said central portion; said player start positions constituting entries into the central portion;

a plurality of property identifying markers that randomly cover a plurality of position marks;

a plurality of obstacle identifying markers that randomly cover a plurality of position marks;

at least one position marker for each player; and a plurality of playing surface determining cards, each having a front side and a back side, with a first group of said cards having property identifying indicia on their front sides, with a second group of said cards having obstacle identifying indicia on their front sides, and with a third group of said cards having other identifying indicia on their front sides, whereby the cards can be shuffled or otherwise mixed with their face sides concealed, and then dealt face down on the areas of the central portion of the playing board, and then turned over, and each card of the first group of cards can be replaced with a property marker corresponding to property identified on the card, and each card of the second group of cards can be replaced by an obstacle marker corresponding to an obstacle on the card, and wherein the third group of cards are merely removed from the board, so as to expose for use in the play of the game the position marks on the areas from which such cards are removed.

2. A board game according to claim 1, wherein said position marker is given a numerical value, and wherein said board game includes chance means for displaying a numerical indicia, so that during the play of the game a player, while it is his turn, can use the chance means to produce a numerical indicia and a predetermined relationship between such indicia and the numerical value assigned to another player's position marker can be used for determining the outcome of a competitive confrontation of the two players.

3. A board game according to claim 1, wherein the theme of the game involves space travel and the property identifying indicia on the first group of cards identifies a planet and the property identifying markers represent planets.

4. A board game according to claim 1, wherein the obstacle identifying indicia on the second group of cards identifies a thing in space and the obstacle identifying marker represent such thing in space.

5. Board game according to claim 4, wherein the theme of the game involves space travel and the indicia on the second group of cards represents a thing in space and the obstacle identifying marker also identifies such thing in space.

6. Board game according to claim 5, wherein the thing in space is one or more asteroids or the like.

7. A board game according to claim 6, wherein the things in space vary in size and shape.

8. A board game according to claim 1 further comprising a plurality of value chips which are acquired by the players during the play of the game.

9. A board came according to claim 8, wherein the theme of the game involves space travel and the value chips represent natural resources.

10. A board game according to claim 9, wherein the value chips are of three types representing three different values.

11. A board game according to claim 1, wherein the theme of the game invoves space travel and each player has two types of position markers, each representing a different type of space ship.

12. A board game according to claim 1, comprising chance means of a type operable to display one of a range of numbers starting with the low number and continuing up to a substantially higher number, said range involving at least fifteen different numbers.

13. A board game according to claim 12, wherein the chance means is a multi-sided dice, with a number on each of its sides.

14. A board game according to claim 1, wherein a numerical value is assigned to each position marker which is intermediate the range of the chance means, and indicia stating said value.

15. A board game according to claim 14, wherein the value indicia is on the game board adjacent a player's start position.

16. A board game according to claim 15, wherein the value indicia indicates strength of the position markers.

17. A board game according to claim 1, wherein the third group of cards indicate open space that allows all position marks to be utilized for movement of the position markers in the pattern of area covered by a card from the third group of cards.

18. A board game according to claim 1, wherein the pattern of areas are further defined as quadrants, each quadrant having a plurality of position marks.

19. A board game according to claim 18 wherein one quadrant is a sun quadrant.

20. A board game according to claim 19, wherein the portion of the sun quadrant is occupied by a sun marker which cannot be entered by a position marker.

21. A board game according to claim 1, wherein the player start positions include an information indicia area.

22. A board game according to claim 1, wherein the player start positions comprise eight position marks; and a position for a galactic base.

23. A board game according to claim 1, wherein the property marker is a planet.

24. A board game according to claim 23, wherein the planet is given a numerical value to allow acquisition of the planet by a player.

25. A board game according to claim 23, wherein the planet is given a numerical value to allow destruction of the planet by a player.

26. A board game according to claim 1, wherein the start position comprises ship function information to allow the player to identify his mode of movement.

* * * * *